US007579993B2

(12) United States Patent
Lev et al.

(10) Patent No.: US 7,579,993 B2
(45) Date of Patent: Aug. 25, 2009

(54) ELECTRONIC DEVICE DETACHABLE ANTENNA ASSEMBLY

(75) Inventors: Jeffrey A. Lev, Cypress, TX (US); Paul J. Doczy, Cypress, TX (US); Mark S. Tracy, Tomball, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 334 days.

(21) Appl. No.: 11/591,248

(22) Filed: Nov. 1, 2006

(65) Prior Publication Data

US 2008/0100518 A1 May 1, 2008

(51) Int. Cl.
*H01Q 1/24* (2006.01)

(52) U.S. Cl. ..... 343/702; 343/906

(58) Field of Classification Search ..... 343/702, 343/904, 906

See application file for complete search history.

(56) References Cited

U.S. PATENT DOCUMENTS 5,343,213 A * 8/1994 Kottke et al. ..... 343/702
5,422,651 A 6/1995 Chang
5,440,315 A 8/1995 Wright et al.
5,644,320 A 7/1997 Rossi
5,867,131 A * 2/1999 Camp et al. ..... 343/797
5,983,073 A 11/1999 Ditzik
6,259,410 B1 7/2001 Chang
6,266,017 B1 7/2001 Aldous
6,359,591 B1 3/2002 Mou
6,419,506 B2 * 7/2002 Jones et al. ..... 439/131
6,421,235 B2 7/2002 Ditzik
6,469,681 B1 * 10/2002 Jones et al. ..... 343/906
6,847,830 B1 1/2005 Vanderhelm et al.
6,908,324 B1 * 6/2005 Morley et al. ..... 439/218
6,970,678 B1 11/2005 Ditzik
2003/0080906 A1 * 5/2003 Miyasaka ..... 343/702
2004/0140937 A1 * 7/2004 Yang ..... 343/702
2007/0205960 A1 * 9/2007 Fujikawa et al. ..... 343/906
2007/0285320 A1 * 12/2007 Hayes et al. ..... 343/702

OTHER PUBLICATIONS

International Search Report dated Apr. 17, 2008.

* cited by examiner

*Primary Examiner*—HoangAnh T Le

(57) ABSTRACT

An electronic device detachable antenna assembly comprises a connector member coupled to an electronic device and configured to receive an external antenna in pluggable engagement therewith, the antenna and the connector member movable between a stored position on the electronic device and an extended position relative to the electronic device.

20 Claims, 1 Drawing Sheet

ELECTRONIC DEVICE DETACHABLE ANTENNA ASSEMBLY

BACKGROUND OF THE INVENTION

As electronic devices decrease in size, component placement within electronic devices becomes increasingly difficult. As a result, some components are more susceptible to interference from other closely-spaced components. For example, as wireless antennas are positioned in close proximity to other components of the electronic device, antenna performance decreases. Externally mounted antennas are sometimes utilized to attempt to increase performance; however, such antennas are more susceptible to damage.

BRIEF DESCRIPTION OF THE DRAWINGS

For a more complete understanding of the present invention, and the objects and advantages thereof, reference is now made to the following descriptions taken in connection with the accompanying drawings in which.

DETAILED DESCRIPTION OF THE DRAWINGS

Figures 1, 2, 3A, 3B:
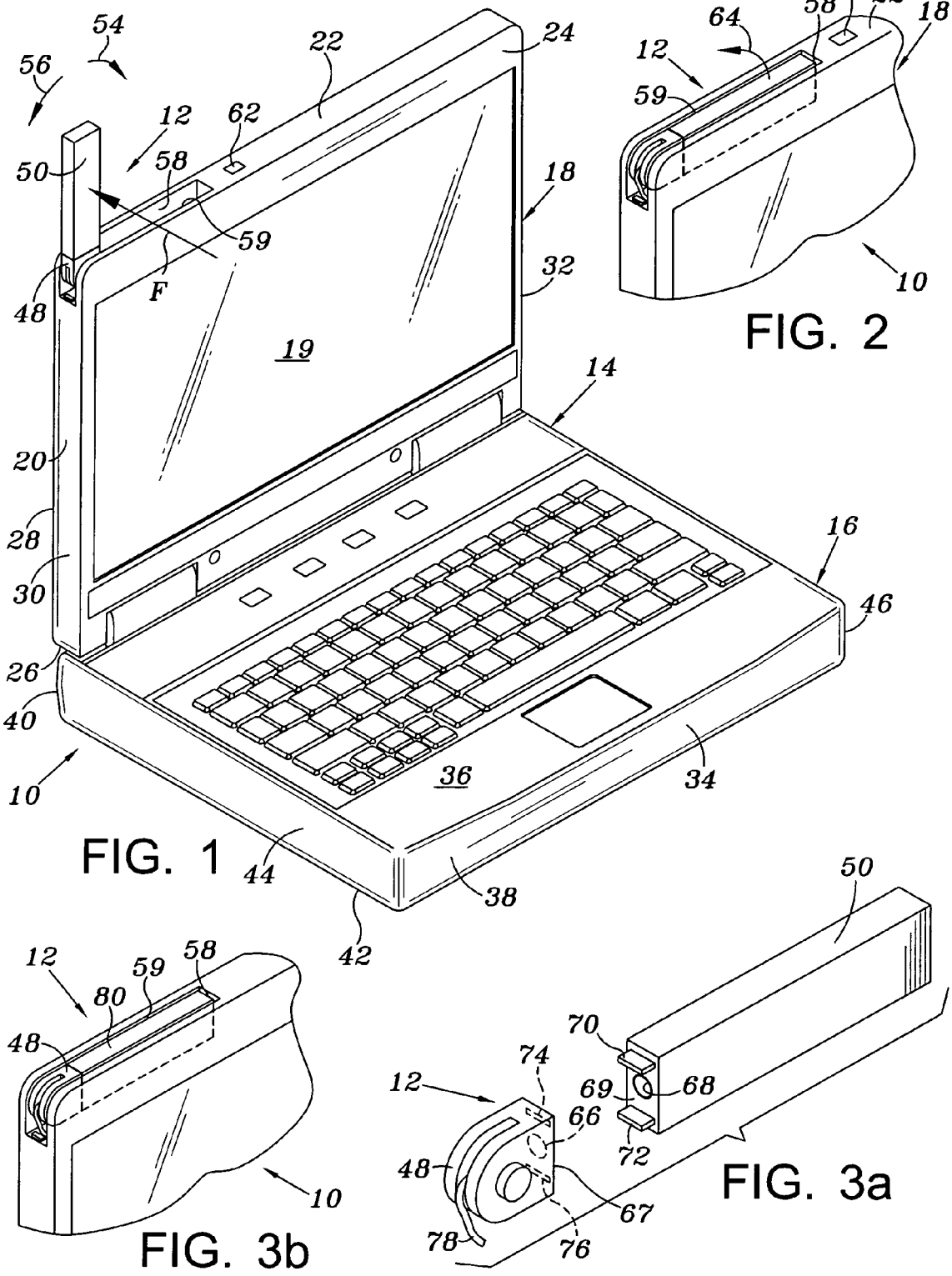
FIG. 1 is a diagram illustrating an electronic device employing an embodiment of a detachable antenna assembly.
FIG. 2 is diagram illustrating a portion of the electronic device of FIG. 1 in which the detachable antenna assembly is disposed in a stored position.
FIG. 3*a* is an exploded diagram illustrating the detachable antenna assembly of FIGS. 1 and 2.
FIG. 3*b* is a diagram illustrating the antenna of FIGS. 1-3*a* replaced with a spacer element disposed thereon.

The preferred embodiments of the present invention and the advantages thereof are best understood by referring to FIGS. 1-3*b* of the drawings, like numerals being used for like and corresponding parts of the various drawings.

FIG. 1 is a diagram illustrating an electronic device 10 employing an embodiment of a detachable antenna assembly 12. In the embodiment illustrated in FIG. 1, electronic device 10 comprises a notebook or laptop computer 14; however, it should be understood that electronic device 10 may comprise other types of computer devices such as, but not limited to, tablet personal computers, handheld computing devices, or any other portable or non-portable computing device. In the embodiment illustrated in FIG. 1, electronic device 10 comprises a base member 16 rotatably coupled to a display member 18. Display member 18 comprises a housing 20 having a top surface 22, a front surface 24, a bottom surface 26, a rear surface 28 and a pair of side surfaces 30 and 32 supporting a display screen 19. Base member 16 comprises a housing 34 having a working surface 36, a front surface 38, a rear surface 40, a bottom surface 42, and a pair of side surfaces 44 and 46.

In the embodiment illustrated in FIG. 1, antenna assembly 12 comprises a connector member 48 rotatably secured to electronic device 10 and an antenna 50 removably coupleable to connector member 48. Preferably, connector member 48 is permanently attached to electronic device 10 such that at least partial disassembly of electronic device 10 may be required to remove connector member 48. However, it should be understood that in some embodiments, connector member 48 may be attached to computer device 10 in a different manner. In the embodiment illustrated in FIG. 1, connector member 48 is coupled to a peripheral location of electronic device 10 (e.g., in FIG. 1, connector member 48 is located at a corner of display device 18). In some embodiments, connector member 48 is coupled to electronic device 10 such that connector member 48 is contained and/or otherwise remains within the envelope or profile of electronic device 10 (e.g., of display member 18) throughout its range of movement and/or rotation to reduce or eliminate the likelihood of damage to connector member 48. For a better appreciation of the relationship between connector member 48 and antenna 50, connector member 48 is illustrated in FIG. 1 as extending at least partially beyond the profile of display member 18. However, it should be understood that in different embodiments, connector member 48 may be coupled to electronic device 10 to remain within the profile of electronic device or extend beyond the profile of electronic device 10 (e.g., remain entirely within the profile, mostly within the profile, mostly within the profile when in extended position, entirely within the profile in the non-extended position, etc.). Connector member 48 is communicatively coupled to a wireless radio module disposed in electronic device 10 to facilitate wireless communications by electronic device 10. According to some embodiments, antenna 50 comprises a wide area network (WAN) antenna that is over-molded in a rubber covering; however, it should be understood that antenna 50 may be otherwise configured (e.g., without a rubber covering) and comprise any type of antenna 50 for use in a number of different wireless communication applications.

In the embodiment illustrated in FIG. 1, antenna 50 is configured to be detachable from connector member 48 to enable replacement of antenna 50 without removal and/or replacement of connector member 48 in the event antenna 50 is damaged or becomes unworkable. Furthermore, if excessive force is applied to antenna 50, antenna 50 is configured to separate from connector member 48, thereby reducing the likelihood of damage to antenna 50 and/or other components of electronic device 10 (e.g., connector member 48, display member 18, and/or display screen 19) that may otherwise result if excessive force, such as the force illustrated by arrow F, is applied to antenna 50.

In the embodiment illustrated in FIG. 1, antenna assembly 12 is rotatably secured to display member 18 adjacent top surface 22; however, it should be understood that antenna assembly 12 may be otherwise disposed (e.g., adjacent to any surface 24, 26, 28, 30 and/or 32 on display member 18 or secured adjacent to any surface 36, 38, 40, 42 or 44 on base member 16). While antenna assembly 12 is illustrated in FIG. 1 as being rotatably secured to display member 18, it should be understood that antenna assembly 12 may be otherwise secured to display member 18 (e.g., telescopingly extendable and/or frictionally engageable to display member 18 or base member 16). Regardless of the mounting configuration, it should be understood that connector member 48 is preferably contained within the profile of electronic device 10 to reduce or eliminate the likelihood of damage to connector member 48.

In FIG. 1, antenna assembly 12 is illustrated as being positioned and/or disposed in one of a plurality of extended positions relative to electronic device 10 where antenna assembly 12 extends outwardly from display member 18. In the embodiment illustrated in FIG. 1, antenna assembly 12 is disposed in an extended position such that antenna assembly 12 is perpendicular to surface 22; however, it should be understood that antenna assembly 12 may be rotated in the directions indicated by arrows 54 and 56 to different extended positions relative to electronic device 10. Thus, in the embodiment illustrated in FIG. 1, antenna assembly 12 may be rotated in excess of one hundred eighty degrees relative to electronic device 10 to facilitate a variety of different extended positions of antenna assembly 12.

In the embodiment illustrated in FIG. 1, display member 18 comprises an externally disposed recessed area 58 configured to receive antenna assembly 12. In FIG. 1, recessed area 58 comprises an elongated opening 59 disposed along surface 22. Recessed area 58 protects antenna assembly 12 against excessive and/or damaging contact when disposed therein. For example, when electronic device 10 is carried or transported, antenna assembly 12 is insertable within or substantially within recessed area 58 to protect antenna 50 from damage. It should be understood that some embodiments of antenna assembly 12 are operable while disposed within recessed area 58 depending on factors such as for example, wireless signal strength and orientation of electronic device 10.

FIG. 2 is diagram illustrating a portion of electronic device 10 of FIG. 1 in which antenna assembly 12 is illustrated in a stored and/or retracted position relative to electronic device 10. In the embodiment illustrated in FIG. 2, antenna assembly 12 is disposed within recessed area 58 and flush (e.g., flush or slightly above/below) with adjacent surface 22 of display member 18 to reduce or eliminate potentially damaging contact to antenna assembly 12 and provide an aesthetically pleasing appearance.

According to some embodiments, to transition antenna assembly 12 to an extended position (such as that illustrated in FIG. 1) from the stored position (FIG. 2), an eject button 62, such as a push-push button, is actuated to at least partially lift antenna assembly 12 outwardly from recessed area 58 in the direction indicated by arrow 64, thereby enabling at least a portion of antenna assembly 12 to be used as a grip for rotating antenna assembly 12 to the desired extended position. It should be understood that other methods and/or devices may be used for transitioning antenna assembly 12 from the retracted or stored position (e.g., providing a finger slot for access to recessed area 58 for manual ejection, providing a push-push mechanism for ejection of antenna assembly 12, and/or providing a software interface command to automatically at least partially eject antenna assembly 12 from recessed area 58).

According to some embodiments, antenna assembly 12 is lockable while in an extended position or the stored position to prevent undesired movement of antenna assembly 12. Antenna assembly 12 may be configured such that frictional forces between assembly 12 and electronic device 10 maintain antenna assembly 12 in a locked/stationary position. In some embodiments, eject button 62, in addition to or in lieu of ejecting antenna assembly 12 from recessed area 58, may also be configured to secure/lock antenna assembly 12 in one of a variety of different positions relative to computer device 10.

FIG. 3*a* is a diagram illustrating an exploded view of antenna assembly 12 of FIGS. 1 and 2. In the embodiment illustrated in FIG. 3*a*, connector member 48 comprises a connector element 66 configured to communicatively couple to a corresponding connector element 68 disposed on antenna 50 to facilitate communications between connector member 48 and antenna 50. In the embodiment illustrated in FIG. 1, connector element 66 is disposed relative to a surface 67 of connector member 48 to provide surface-to-surface contact with connector element 68 disposed on a surface 69 of antenna 50 (e.g., connector elements 66 and 68 are preferably disposed in a slightly elevated position relative to surfaces 67 and 69, respectively, to facilitate contact therebetween when antenna 50 is coupled to connector member 48). However, it should be understood that other methods of attachment may be used (e.g., connector element 66 extending outward into a corresponding recess on antenna 50).

In the embodiment illustrated in FIG. 3*a*, antenna 50 comprises extensions 70 and 72 configured for insertion into corresponding openings 74 and 76 disposed on connector member 48 to frictionally and/or otherwise secure antenna 50 to connector member 48. Thus, antenna 50 and connector member 48 are configured to enable antenna 50 to be readily pluggable into connector member 48 so as to be easily attached and removed therefrom. Furthermore, in the embodiment illustrated in FIG. 3*a*, extensions 70 and 72 prevent rotational movement of antenna 50 while coupled to connector member 48. However, it should be understood that other methods or devices may be used to secure antenna 50 to connector member 48 (including ones that enable rotational movement of antenna 50 relative to connector member 48). It should also be understood that a greater or fewer number of extensions 70 and 72 may be used to secure antenna 12 to connector member 48. In the embodiment illustrated in FIG. 3*a*, a cable 78 communicatively couples antenna assembly 12 to a wireless radio module disposed in electronic device 10 to facilitate communications therebetween.

In some embodiments, if excessive and/or inadvertent force is exerted on antenna 50 (e.g., when an object or person contacts antenna 50 with a force F (FIG. 1)) when assembly 12 is disposed in an extended position (e.g., FIG. 1), antenna 50 and/or connector member 48 is configured to cause antenna 50 to automatically detach from connector member 48, thereby eliminating or substantially reducing a likelihood of damage to connector member 48, antenna 50 and/or display member 18. In some embodiments, extensions 70 and 72 are configured to be releasable from openings 74 and 76 in response to such force; however, it should be understood that extensions 70 and 72 may be designed as sacrificial extensions (e.g., designed to break or shear in response to a predetermined amount of force being applied to antenna 50 relative to connector member 48). Further, in instances where antenna 50 does becomes damaged and/or is no longer usable, antenna 50 is easily removable from connector member 48 for repair or replacement without the need to ship/transport electronic device 10 and/or antenna assembly 12 for repair and/or replacement. It should also be understood that the locations of extensions 70 and 72 and corresponding openings 74 and 76 may be reversed (e.g., extensions 70 and 72 formed on connector member 48 and openings 74 and 76 disposed in antenna 50).

FIG. 3*b* is a diagram illustrating antenna assembly 12 of FIGS. 1-3*a* with a spacer element 80 instead of antenna 50. In the event that particular models of electronic device 10 are sold, shipped and/or used without a wireless communications system and the need for antenna 50, antenna assembly 12 is configurable such that antenna 50 is replaced with an identically or nearly identically spacer 80 to fill recessed area 58 and maintain an aesthetically pleasing appearance of electronic device 10. Thus, spacer 80 obviates the need to redesign base member 16 and/or display member 18 for electronic devices configured without wireless communication capability while enabling a later modification of electronic device 10 to include such wireless communication ability (e.g., by replacing spacer 80 with antenna 50).

Thus, embodiments provide a rotatably mounted antenna assembly 12 operable between a number of different extended positions and a stored position to reduce and/or eliminate damage to antenna assembly 12. Furthermore, antenna 50 is detachable from antenna assembly 12 such that in the event that antenna 50 is contacted or contacts an object with an excessive force, antenna 50 will detach from connector member 48 without damage to other components and/or areas of electronic device 10. Embodiments also provide an antenna assembly 12 with a removable antenna 50 for ease of repair or replacement. Further, embodiments provide an antenna assembly 12 with a spacer 80 interchangeable with antenna 50 to provide greater flexibility for electronic device 10 manufacture and upgrade.

What is claimed is:

1. A notebook computer, comprising:

a base;

a display rotatably coupled to the base and including an externally disposed recess;

an antenna; and a connector member disposed in the recess, connected to the antenna, and rotating to move the antenna from a stored position in the recess to an extended position outside of the recess, wherein an extension removably plugs into an opening to frictionally connect the antenna to the connector member.

2. The notebook computer of claim 1, wherein the antenna includes two extensions that plug into two openings in the connector member to frictionally connect the antenna to the connector member and enable the antenna and connector member to be removably connected together.

3. The notebook computer of claim 1, wherein the recess is an elongated opening formed in a housing of the display and is shaped to receive the antenna in the stored position.

4. The notebook computer of claim 1, wherein the antenna is flush with a surface of the display in the stored position to reduce damaging contact with the antenna.

5. The notebook computer of claim 1, further comprising a spacer interchangeably coupleable to the connector member in place of the antenna.

6. The notebook computer of claim 1, wherein the extension breaks upon an excessive force applied to the antenna so the antenna detaches from the connector member to eliminate damage to the connector member and the display.

7. The notebook computer of claim 1, wherein the connector member and the antenna are pluggably engaged via a sacrificial extension.

8. A notebook computer, comprising:

a base;

a display connected to the base and including a housing with a recess;

an antenna disposed in the recess in a stored position; and a connector member rotatably connected to the housing, wherein an end of the antenna and the connector member are secured and removably pluggable to each other with a frictional connection that includes an extension and an opening that receives the extension.

9. The notebook computer of claim 8, wherein the frictional connection includes two extensions extending from the antenna and two openings in the connector member.

10. The notebook computer of claim 8, wherein the connector member and antenna connect to each other via a sacrificial extension.

11. The notebook computer of claim 8, wherein the connector member and the antenna are both contained within the recess and a profile of the electronic device when in the stored position.

12. The notebook computer of claim 8, wherein the antenna includes extensions that frictionally engage openings in the connector member.

13. The notebook computer of claim 8, wherein the antenna automatically detaches from the connector member upon a force being applied to the antenna to reduce a likelihood of damage occurring to the connector member and the display.

14. A notebook computer, comprising:

a base;

a display connected to the base and including a recess;

an antenna; and a connector member disposed in the recess, connected to the antenna, and rotating within the recess to move the antenna from a stored position located in the recess to an extended position located outside of the recess, wherein at least one extension plugs into an opening so the antenna frictionally engages the connector member to be removably pluggable with the connector member.

15. The notebook computer of claim 14 wherein the recess is elongated and shaped to store the connector member and antenna and protect the antenna against damage while the antenna is in the stored position.

16. The notebook computer of claim 14 wherein the antenna includes two extensions that plug into two openings in the connector member.

17. A notebook computer, comprising:

a housing with a display and a base;

an antenna movable between a stored position disposed in a recess of the housing and an extended position extending outwardly from the recess; and a connector member that rotatably connects the antenna to the housing, wherein an extension fits into an opening to frictional secures and removably connect an end of the antenna to the connector member.

18. The notebook computer of claim 17, wherein the recess has an elongated shape located in a housing of the display.

19. The notebook computer of claim 17, wherein the antenna fits in the recess and is flush with a surface of the display in the stored position.

20. The notebook computer of claim 17, wherein the antenna includes two extensions that are in pluggable engagement with two openings in the connector member.

* * * * *

UNITED STATES PATENT AND TRADEMARK OFFICE

CERTIFICATE OF CORRECTION

PATENT NO. : 7,579,993 B2
APPLICATION NO. : 11/591248
DATED : August 25, 2009
INVENTOR(S) : Jeffrey A. Lev et al.

It is certified that error appears in the above-identified patent and that said Letters Patent is hereby corrected as shown below:

In column 6, line 40, in Claim 17, delete "secures" and insert -- secure --, therefor.

Signed and Sealed this

Thirtieth Day of March, 2010

David J. Kappos

David J. Kappos
*Director of the United States Patent and Trademark Office*